United States Patent [19]

Martin

[11] Patent Number: 4,786,337

[45] Date of Patent: Nov. 22, 1988

[54] METHOD OF TREATING ALUMINUM-LITHIUM ALLOYS

[75] Inventor: Gardner R. Martin, Redondo Beach, Calif.

[73] Assignee: Rockwell International Corporation, El Segundo, Calif.

[21] Appl. No.: 172,876

[22] Filed: Mar. 25, 1988

[51] Int. Cl.[4] ..... C22F 1/04

[52] U.S. Cl. ..... 148/11.5 A; 148/13.1

[58] Field of Search ..... 148/13.1, 11.5 A, 159

[56] References Cited

U.S. PATENT DOCUMENTS 4,534,807 8/1985 Field et al. ..... 148/20.3

*Primary Examiner*—R. Dean

*Attorney, Agent, or Firm*—Max Geldin; Charles T. Silberberg

[57] ABSTRACT

A process for heat treating an aluminum-lithium alloy material while preventing formation of lithium oxide and attendant lithium loss and associated strength degradation of the alloy, by application of a copper plating on the aluminum-lithium alloy material by electroplating, prior to heat treatment, and removing the copper plate subsequent to heat treatment by treating the aluminum-lithium alloy material in a suitable acid bath, such as an aqueous nitric acid solution.

17 Claims, No Drawings

METHOD OF TREATING ALUMINUM-LITHIUM ALLOYS

BACKGROUND OF THE INVENTION

This invention relates to the treatment of aluminum-lithium alloys prior to heat treatment thereof and is particularly directed to a method of preventing lithium oxide formation in aluminum-lithium alloys during high temperature processing, e.g., solution heat treating, by application of a metal plate which can be readily removed following such processing.

When the recently developed aluminum-lithium alloys are processed at high temperature, such as at the solution heat treatment temperature or superplastic forming temperatures, lithium loss occurs, resulting in attendant alloy loss and associated property degradation. This is due to the propensity of Al-Li alloys to oxidize at high temperature, as noted in the article, "Effects of Lithium Loss on Strength and Formability of Aluminum-Lithium Alloys 8090 and 8091", J. M. Papazian, et al, *Materials, Science and Engineering,* 94 (1987), 219–224. Thus, the high temperature processing of any of the advanced Al-Li alloys will result in (1) lithium loss, due to formation of lithium oxide with the amount of lithium loss being dependent on time and temperature, (2) the lithium loss will result in an attendant loss in strength, particularly tensile strength of the alloy, and (3) the loss in strength will be a function of sheet gage, with the thinner gages being affected the most. At the solution heat treatment temperature, typically carried out at a temperature in the range of about 900° to about 1,000° F., a substantial loss of the lithium content of the alloy may occur, particularly with thin section material, within normal heat treatment times due to reactivity of lithium with the furnace atmosphere. Also, lithium oxide/hydroxide poses health concerns relative to breathing the oxide, which has been identified as an irritant.

Nevertheless, aluminum-lithium alloys are now of considerable interest for the production of structural components having a high strength/weight ratio.

U. S. Pat. No. 4,534,807 discloses heat treatment of an aluminum-lithium alloy being carried out in an atmosphere of carbon dioxide and water vapor, the partial pressure of the water vapor in such atmosphere being at least 4 torr. The patentee states that this treatment is effective in reducing oxidation of lithium in heat treatments carried out at temperatures in excess of 450° C.

U. S. Pat. No. 3,404,998 discloses a method of metal plating aluminum alloys without permanent loss of strength or hardness due to annealing caused by high plating temperatures. The method comprises decomposition of a bis (arene) metal compound, the metal being vanadium, niobium, tantalum, chromium, molybdenum or tungsten, to form a metal plate on the aluminum alloy, followed by solution heat treatment and precipitation hardening to restore the strength and hardness to substantially their original levels.

U. S. Pat. No. 4,654,091 discloses protection of the free surfaces of a nickel superalloy article from oxidation and subsequent quench cracking during heat treatment by the application of a thin layer of nickel plate. The patentee states in column 1 of the patent that in the carburizing of steel, it is known to use localized copper plating to eliminate carburizing of selected surface portions. The patentee further states, however, that copper is an element known to adversely affect superalloys and, hence, is apparently undesirable for use therewith.

An object of the present invention is to provide a process for heat treatment of aluminum-lithium alloys while avoiding oxidation of lithium to lithium oxide.

Another object of the invention is the provision of relatively simple procedure for the treatment of aluminum-lithium alloys prior to high temperature heat treatment thereof, to avoid lithium loss and degradation of the mechanical properties of the aluminum-lithium alloy, e.g., tensile strength, resulting from such lithium loss.

A particular object of the present invention is to provide procedure to prevent oxidation of lithium in aluminum-lithium alloys during high temperature treatment thereof, by the application of a surface barrier on the aluminum-lithium alloy parts prior to heat treatment, which prevents such oxidation and attendant degradation of the properties of such aluminum-lithium alloys, followed by simple removal of the surface barrier after heat treatment.

SUMMARY OF THE INVENTION

According to the invention, it has been found that copper plating of the aluminum-lithium alloy material or part prior to high temperature processing, e.g., solution heat treating or superplastic forming, provides a barrier to the formation of lithium oxide and associated lithium loss, thus avoiding degradation of strength and other mechanical properties during such high temperature processing. The copper plating of the aluminum-lithium alloys can be accomplished by an electrolytic plating process. After high temperature processing, the copper plate can be readily stripped from the surface of the aluminum-lithium alloy material by treatment in an acid bath, such as nitric acid, which will not degrade the aluminum-lithium base material.

The copper plating of the aluminum-lithium alloy materials, followed by removal or stripping of the copper plate following high temperature processing, can be readily and economically carried out. Since the heat treatment of aluminum-lithium alloy materials, for example, heat treatment requiring both a solution heat treatment plus aging to achieve optimum properties, is generally required, the process of the invention has wide application.

Further, the reduction or elimination of lithium oxide formation during high temperature processing offers the advantages noted above, while at the same time reducing or eliminating health hazards associated with formation of lithium oxide during high temperature processing of the aluminum-lithium alloys. Thus, the method of the invention offers an economical means for solving this problem.

Also, the invention process, while reducing lithium loss, provides other benefits. Thus, for example, with respect to superplastic forming of Al-Li alloys, there is the potential for improved part/tool friction reduction, in addition to oxidation protection and associated reduction in environmental concerns.

DETAILED DESCRIPTION OF THE INVENTION AND PREFERRED EMBODIMENTS

According to the invention, a thin layer of copper is applied by electroplating to the surface of an aluminum-lithium article prior to heat treatment thereof to protect the surface of the alloy against oxidation of the lithium component of the alloy during such heat treatment.

Various aluminum-lithium alloys can be treated according to the invention process. Aluminum-lithium alloys containing at least 1% of lithium by weight, and preferably at least 2% by weight, particularly 2–3%, of lithium, can be effectively processed according to the invention. These include, for example, the 2090 series of aluminum-lithium alloys containing from about 2 to about 2.5% lithium by weight, and also minor portions of copper, approximately 2.7% by weight. Also, the 8090 and 8091 series of aluminum-lithium alloys are suitable for treatment according to the invention. The 8090 series of aluminum-lithium alloys contain 2.5% lithium, 1.22% copper, and 0.70% magnesium, by weight, and also minor amounts of zirconium, iron, silicon and titanium. The 8091 series of aluminum-lithium alloys contains 2.46% lithium, 1.86% copper and 0.83% magnesium, by weight, together with minor amounts of zirconium, iron, silicon and titanium A thin layer of copper is applied to the aluminum-lithium article by contacting such article in a copper plating bath.

Prior to electroplating, the aluminum-lithium alloy can be treated in a suitable solution to slightly etch the surface of the alloy to more readily accept a copper plate, although such prior treatment is not essential.

The Al-Li alloy is then subjected to treatment in the copper plating solution, which can be in the form of an aqueous copper sulfate-sulfuric acid solution. Electroplating can be carried out at room temperature or at elevated temperature and at sufficient current density and for a time such as to deposit the requisite thickness of copper plate on the Al-Li alloy article. The details of the copper plating process are well-known and do not form a part of the present invention.

The thickness of the copper plate is sufficient to form an adherent and essentially non-porous copper coating on the aluminum-lithium alloy so as to provide a barrier to the formation of lithium oxide and associated lithium loss, during subsequent heat treatment thereof. The thickness of the copper plate applied will depend on the specific heat treating conditions employed. Thus, for example, if solution heat treatment is to be carried out, the thickness of the copper plate can be greater than where superplastic forming is to be carried out, since during superplastic forming, stretching or expansion of the aluminum-lithium alloy sheet takes place. Thus, the thickness of the copper plate generally should be less than about 5 mils and preferably of the order of about 0.5 mil, e.g., about 0.5 to about 1 mil, when applied to the free surface of the alloy, as a barrier against migration of lithium at high temperature, to thus prevent formation of lithium oxide or hydroxide.

Following application of the copper plate to the aluminum-lithium alloy article, the alloy is then subjected to the selected heat treatment, usually carried out at a temperature above about 900° F. In one form of such heat treatment, the aluminum-lithium alloy article is subjected to solution heat treatment which comprises a heating step and a quenching step. Such heat treatment can be carried out either in an air furnace or in a sodium nitrate salt bath, preferably the former, at a temperature ranging from about 930° to about 970° F. In this procedure, the aluminum-lithium alloy is converted to a substantially homogeneous solid solution.

After the alloy is at the solution heat treatment temperature for a sufficient period, it is then quenched, i.e., rapidly cooled, in water or oil, to form a supersaturated solid solution. Quenching can be carried out by spraying the copper plated alloy with water or oil or other suitable quenching liquid, or by dipping the plated alloy in the quenching medium. In the quenching procedure, the alloy is reduced from solution heat treatment temperature, e.g., down to room temperature in a short period, e.g., a few minutes, or less.

As a final step in solution heat treatment, the copper plated Al-Li alloy can be subjected to an aging or precipitation hardening treatment to achieve optimum properties, which comprises maintaining the alloy at a suitable temperature, e.g., at room temperature, and preferably at elevated temperature, e.g., up to about 250° to about 375° F. for a suitable time, e.g., several hours, so that precipitation with resultant rehardening and restrengthening of the alloy occurs.

During such solution heat treatment procedure, the copper plate remains adherent to the surface of the alloy and does not oxidize during such heat treatment.

Alternatively, where superplastic forming is to be carried out on the copper plated aluminum-lithium alloy, the alloy is heated in a suitable die at a temperature ranging from about 930° to about 970° F. during superplastic forming, and expanding the alloy in the die, followed by suitable cooling of the superplastically formed article. After superplastic forming, a final heat treatment of the expanded Al-Li alloy structure, e.g., by solution heat treatment above about 900° F., e.g., at about 920° F., may be performed in order to impart a desired strength or toughness to the alloy.

When the aluminum-lithium alloy article is subjected to the aforementioned elevated temperature during superplastic forming, the copper plate may also aid against friction between the die and the alloy in the press.

Both of the above heat treatment procedures, that is, solution heat treatment and superplastic forming, are well-known and per se form no part of the present invention.

The heat treated aluminum-lithium alloy article containing the copper plate is then subjected to treatment in an acid bath under conditions to remove the copper plate without degrading or deleteriously affecting the aluminum-lithium alloy base metal. A suitable acid solution for this purpose is an aqueous nitric acid bath. However, other suitable acid baths for this purpose can be employed.

It has been found that by application of a copper plate to an aluminum-lithium alloy prior to heat treatment thereof according to the invention, prevention of formation of lithium oxide results, and lithium loss is avoided, thus maintaining the strength of the aluminum-lithium alloy afforded by the precipitation of aluminum-lithium compounds in the alloy during such heat treatment.

The following is an example of practice of the invention.

A 2090 aluminum-lithium alloy sheet is immersed in a nickel strike solution to slightly etch the surface of the sheet.

The so-treated aluminum-lithium alloy sheet is then immersed in a copper sulfate solution containing 200 ml of water, 44 grams of copper sulfate and sulfuric acid. The electroplating operation is carried out at room temperature and at 80 milliamps per square centimeter current density for 5 minutes. The resulting aluminum-lithium sheet has a thin adherent copper plate of about 0.5 mil thickness.

The copper plated aluminum-lithium sheet is then subjected to solution heat treatment in an air furnace at about 960° F. for approximately 30 minutes and is then quenched by immersion in water. The so-treated Al-Li alloy sheet is then aged at about 350° F. for 16 to 24 hours.

The resulting copper plated aluminum-lithium alloy sheet is then immersed in an aqueous nitric acid solution for a period sufficient to remove the copper plate without degrading the aluminum-lithium base metal surface.

It is found that substantially no conversion of lithium in the aluminum-lithium alloy sheet to lithium oxide occurs, and the mechanical properties including tensile strength of the aluminum alloy sheet are not degraded as a result of the heat treatment carried out on the sheet.

From the foregoing, it is seen that the invention provides an efficient and economical process for prevention of formation of lithium oxide and attendant lithium loss in aluminum-lithium alloy articles or parts during heat treatment, by the application of a suitable copper plate by electroplating, prior to heat treatment, followed by simple removal or stripping of the copper plate after heat treatment.

Since various further modifications of the invention will occur to those skilled in the art, within the spirit of the invention, the invention is not to be taken as limited except by the scope of the appended claims.

What is claimed is:

1. In a process for heat treating an aluminum-lithium alloy article, including the step of heating said article at elevated temperature, the improvement which comprises applying a copper plate on said article prior to said heating step, whereby formation of lithium oxide in said alloy is prevented during said heating step.

2. The process of claim 1, including removing said copper plate from said article after said heating step.

3. The process of claim 1, said copper plate being applied by electroplating said article.

4. The process of claim 2, said copper plate being stripped from said article by treatment in a suitable acid bath which will not degrade the aluminum-lithium alloy base metal.

5. The process of claim 1, said aluminum-lithium alloy article having a lithium content of at least 1% by weight.

6. The process of claim 5, said aluminum-lithium alloy article having a lithium content ranging from about 2% to about 3% by weight and including a small amount of copper.

7. The process of claim 6, said copper plate being applied by electroplating said article, and including the further step of stripping said copper plate from said article after said heating step, by treatment of the copper plated aluminum-lithium alloy article in a suitable acid bath which will not degrade the aluminum-lithium alloy base metal.

8. The process of claim 1, the thickness of said copper plate ranging from about 0.5 to about 1 mil.

9. A process for heat treating an aluminum-lithium alloy article, to prevent lithium oxide formation during heat treatment, which comprises:

electroplating copper on the surface of said article, heat treating said article at a temperature above about 900° F., contacting said heat treated article with a suitable acid bath which will not degrade the aluminum-lithium alloy base metal, and stripping said copper plate from said article.

10. The process of claim 9, said heat treatment comprising solution heat treatment and quenching of said aluminum-lithium alloy article.

11. The process of claim 10, said heat treatment also including a final step of aging said aluminum-lithium alloy article.

12. The process of claim 9, said heat treatment comprising superplastic forming of said alloy article.

13. The process of claim 12, said heat treatment also including the additional step of further heating said copper plated aluminum-lithium alloy article after superplastic forming.

14. The process of claim 9, said heat treatment being carried out at a temperature ranging from about 930° to about 970° F.

15. The process of claim 9, said electroplating being carried out in an aqueous copper sulfate-sulfuric acid solution.

16. The process of claim 9, said acid bath comprising an aqueous nitric acid solution.

17. The process of claim 9, said electroplating being carried out in an aqueous copper sulfate-sulfuric acid solution, said heat treatment being carried out at a temperature ranging from about 930° to about 970° F., and said acid bath comprising an aqueous nitric acid solution.

* * * * *